US005819922A

United States Patent [19]

Martin, Jr.

[11] Patent Number: 5,819,922

[45] Date of Patent: Oct. 13, 1998

[54] SUPPORT SYSTEM FOR FILES

[76] Inventor: Tim Martin, Jr., P.O. Box 649, Lynden, Wash. 98264

[21] Appl. No.: 783,961

[22] Filed: Jan. 15, 1997

Related U.S. Application Data

[60] Provisional application No. 60/010,105 Nov. 16, 1996.

[51] Int. Cl.[6] ..... B65D 63/00

[52] U.S. Cl. ..... 206/214; 206/425

[58] Field of Search ..... 206/214, 215, 206/425, 449, 555, 814

[56] References Cited

U.S. PATENT DOCUMENTS 3,164,430 1/1965 Beem et al. ..... 206/214 X
5,165,534 11/1992 Kaufman et al. ..... 206/214 X

*Primary Examiner*—Jacob K. Ackun
*Attorney, Agent, or Firm*—Jeffrey B. Oster

[57] ABSTRACT

A system for maintaining files and documents in an accessible manner in a file container such that the files are retained in a vertical orientation. The system comprises a plurality of deformable, resilient upper retention members to engage an upper portion of the files, and a lower retention member adapted to engage a lower portion of the same file. Securing both the top and bottom of the file prevents file creep within the file container.

20 Claims, 16 Drawing Sheets

SUPPORT SYSTEM FOR FILES

CROSS REFERENCE TO RELATED APPLICATIONS

This application claims the benefit of U.S. Provisional Application No. 60/010,105, filed Jan. 16, 1996.

BACKGROUND OF THE INVENTION

Filing cabinets are generally of two types: so-called "hanging files" and cabinets where files are simply placed in the cabinet. Hanging files are essentially jackets, or sleeves, hung from the opposing side walls of the cabinet, which retain the files therein. Such files generally require quite rigid side walls, and when provided in built-in desk cabinets, often are used in conjunction with steel rails disposed above or adjacent the cabinet side walls. The steel rails provide the necessary rigidity and durability required to withstand the stresses imposed by hanging files.

By contrast, the more simple filing box has no rigid external support, and containment is effected by the side walls of the box itself, which is often made of corrugated cardboard. Filing in such boxes is effected by merely placing the files into the box, usually on their sides (i.e. an 8"×11" file is placed on its side with the 11" dimension horizontal and the 8" dimension vertical). The problem with this system is that the files tend to "creep"—unless the box is essentially full, the lower portion (foot) of the files tend to move, resulting in the files either laying on their sides or bent when they encounter the end of the box. In either case, the effort required by the user to locate the file is increased, and may result in papers having an unwanted crease or curvature.

The problem of file creep is eliminated with hanging files, since the weight of the files does not rest on the feet of the files, but the cost of such apparatus' is significant, and is not practicable for use with corrugated file boxes. In addition, the structural rigidity of conventional corrugated file boxes may not be sufficient to enable the use of hanging files.

Attempts have been made to solve this problem. Most specifically, U.S. Pat. No. 1,712,177 discloses a file drawer having a rib extending longitudinally on an inner surface of each side of the drawer, each rib having a plurality of vertical slots therein to receive the ends of a separator. The stem of the T-shaped separators rest on the bottom of the drawer, and will presumably prevent file creep, thereby eliminating the need of an apparatus to inhibit movement of the foot of the files. U.S. Pat. No. 3,410,445 discloses a method of dividing up a drawer using vertically-corrugated members attached to the walls of the drawer. Movable dividers may be repositioned to effect units of varying size within the drawer.

U.S. Pat. No. 2,583,081 discloses a shipping carton for packing dishes and other fragile items. A plurality of fins are affixed to opposing surfaces, with a dish disposed between each adjacent pair of fins. The fins are made of sponge rubber in sheet form. Because of the structural rigidity of dishes or plates, only a single set of fins are required to maintain the proper disposition of adjacent articles. A tool case with movable partitions is illustrated in U.S. Pat. No. 4,884,689. The partitions are provided with vertical grooves permitting them to be interfitted in any appropriate shape to securely retain tools therebetween.

BRIEF SUMMARY OF THE INVENTION

The present invention comprises a system adapted to retain documents or files having little or no inherent structural integrity in a substantially vertical alignment within a file container. Such files are generally held within the container in a file folder, but may be placed in the container without a surrounding folder or jacket. Such documents are generally placed in the container on their side, with the long dimension aligned horizontally.

The system includes a plurality of spaced-apart, deformable resilient upper retention members adapted to engage an upper portion of the document or file. The upper retention members are preferably aligned horizontally, and provided on an upper portion of at least one inner side wall of the container. Most preferably, there are upper retention members provided on both side walls. While the upper retention member maintains the file in a fixed location, a lower retention member prevents "file creep"—the tendency of the foot of the file folder or document to move along the bottom of the container under the pressure of its own weight. The upper and lower retention members are easily deformable, permitting a file retained therein to be easily removed.

In a first embodiment, the pairs of upper and lower retention members comprise a support strip with a plurality of projections pointing toward one another and into the center of the container. Adjacent projections are provided with an operative space therebetween sufficient to hold the size of expected files. In an alternative embodiment, the lower retention member comprises a corrugated planar member laying on the bottom of the container, with the ridges and grooves aligned parallel to the projections to securely retain the lower edge of the file to prevent creep. In a further embodiment, the upper (and if desired, the lower) retention members comprise a loop of flexible and deformable material forming an operative holding space therebetween.

The system of the present invention may be manufactured as an after-market apparatus to be installed in permanent filing cabinets or portable filing boxes, or it may be manufactured coincident with the manufacture of the box itself.

In one embodiment, the support strip and the projections may be die-cut from a single piece of flexible material (such as pure gum rubber or synthetic rubber), or may be produced by deforming a strip of such material to produce the projections. In still further embodiments, the present invention may comprise: a removable frame member adapted to sit in the bottom of the box or cabinet, and having a planar base portion with upper and lower arms having retention members thereon; a pair of removable frame members adapted to hang from the side of a file box or cabinet from a pair of hooks; a plurality of individual retention members each having a support portion adapted to engage individual apertures provided in an upper portion of a side wall of the container, and an indexing portion adapted to carry index indicators thereon to identify adjacent files; upper retention members in the form of an elongate portion of deformable material having first and second ends each with hook portions adapted to be interfitted with each other and secured to the sides of the container; and a second form of loop having an elongate portion with crease lines to enable a loop to be made between the two ends.

DETAILED DESCRIPTION OF THE INVENTION

Figure 1:
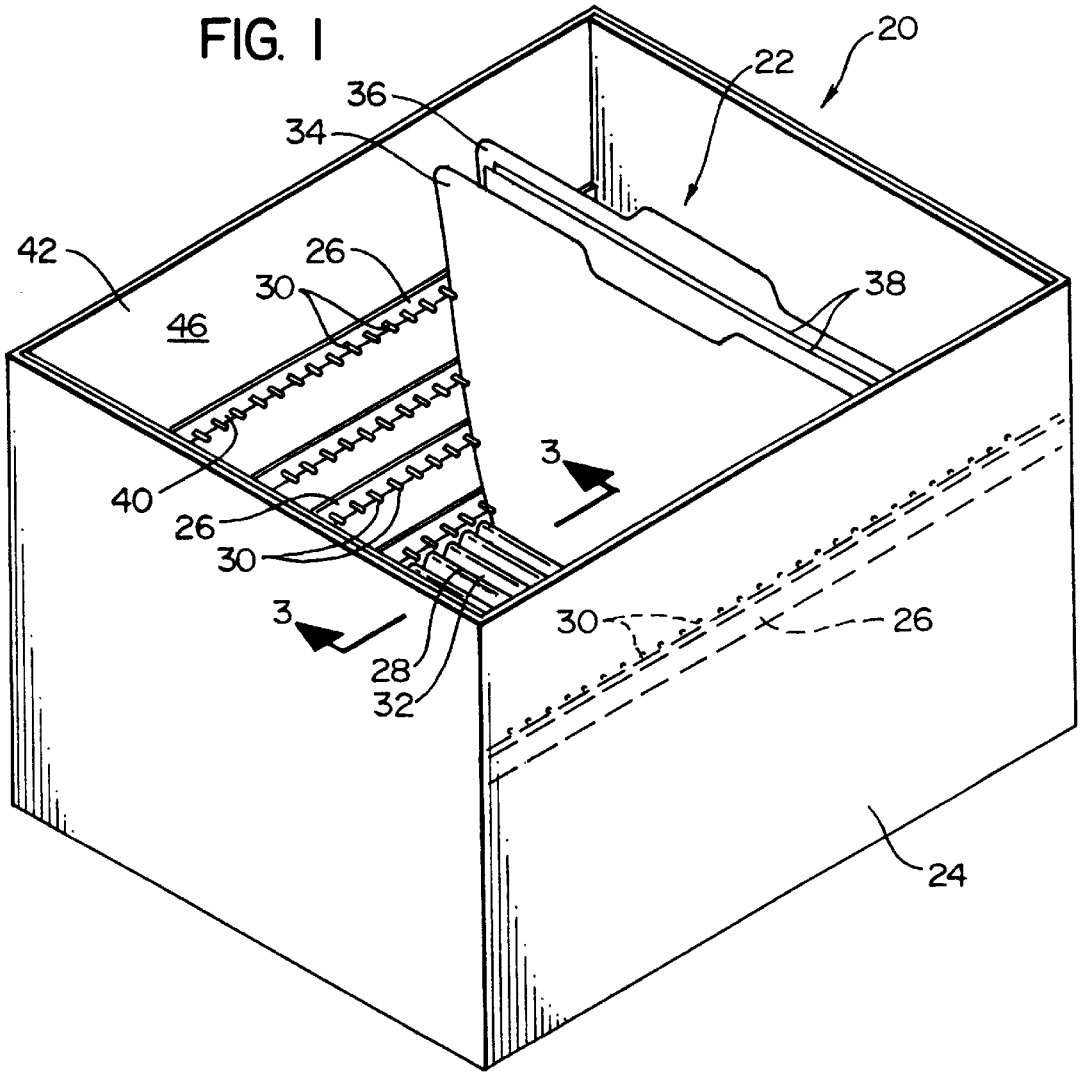
FIG. 1 is a perspective view of a file storage system constructed in accordance with, and embodying, the principles of the present invention.

Referring initially to FIG. 1, shown at 20 therein is a support system for a file shown at 22. The support system 20 basically comprises a paperboard box 24, an upper retention member in the form of at least one support strip 26 on at least one side of the box 24 (one shown in broken lines), and a lower retention member aligned generally horizontally on a lower portion of the box 24. As illustrated, the lower retention member may comprise either a support strip 26 or a corrugated sheet 28 (generally not both). The support strips 26 are securely attached to opposing inner surfaces of the box 24, while the corrugated sheet 28 is securely attached to a bottom surface of this box 24. The support strips 26 comprise inwardly extending projections 30. The strips 26 are attached to the box 24 such that the projections 30 on one of these strips are arranged opposite the projections 30 on the other of these strips. The projections 30 are also generally horizontal in orientation, except as noted below.

The corrugated sheet 28 is arranged such that its grooves and ridges are substantially parallel to the projections 30 extending from the support strips 26.

As shown in FIG. 1, a closed, bottom end 32 of the file 22 is received within one of the grooves of the corrugated sheet 28, while first and second flaps 34 and 36 of the file 22 rest against one or more of the projections 30. The file 22 is thus maintained within the box 24 in a generally upright orientation Therefore, the files 22 do not creep—the unintended sliding of the lower portions of the files (the "feet") in a longitudinal direction—and are thus easily accessible even though there are not enough files in the box to allow them to stand against each other.

Figure 1A:
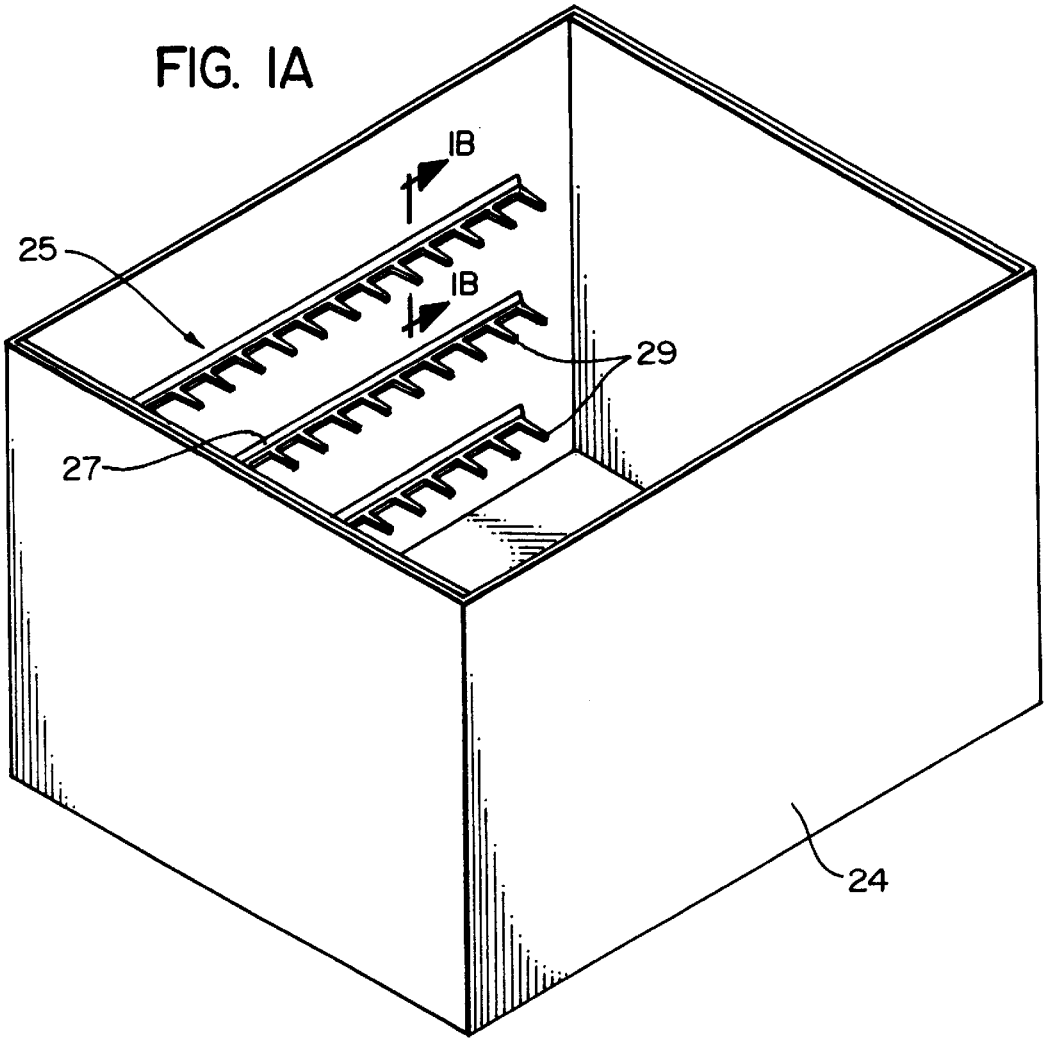
FIG. 1A is a perspective view of an alternative embodiment of the present invention.
Figure 1B:
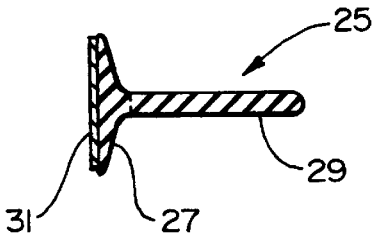
FIG. 1B is a sectional view taken along lines 1B—1B of FIG. 1A.

The support strip and projections can be manufactured in a single manufacturing step by stamping, die-cutting or extruding the unitary strip 25 from a single piece of material as illustrated in FIGS. 1A and 1B. The base portion 27 and projection 29 of this embodiment may be affixed to the inner surface of the box 24, as by adhesive 31.

Figure 2:
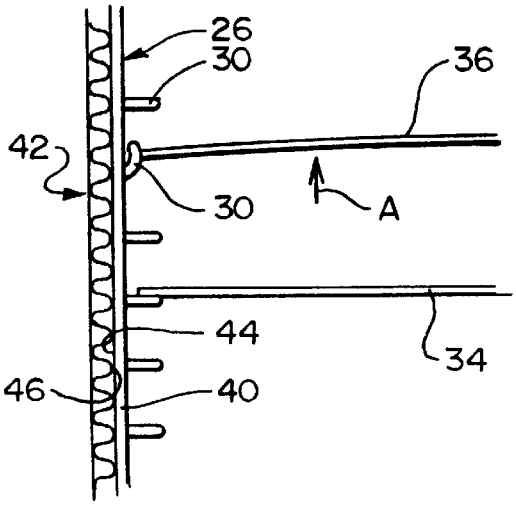
FIG. 2 is a partial top plan view showing that files may be rearranged by distorting projections used by the system 20.
Figure 3:
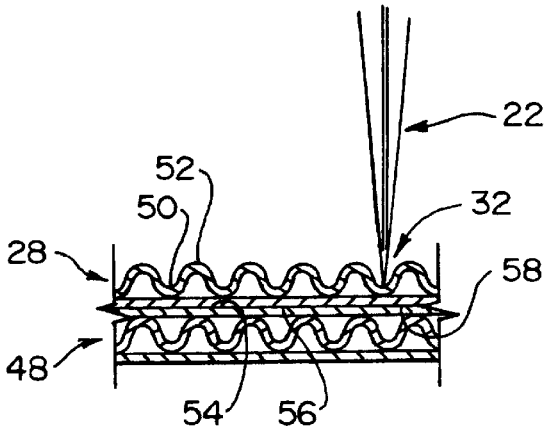
FIG. 3 is side cutaway view taken along lines 3—3 in FIG. 1.
Figure 4:
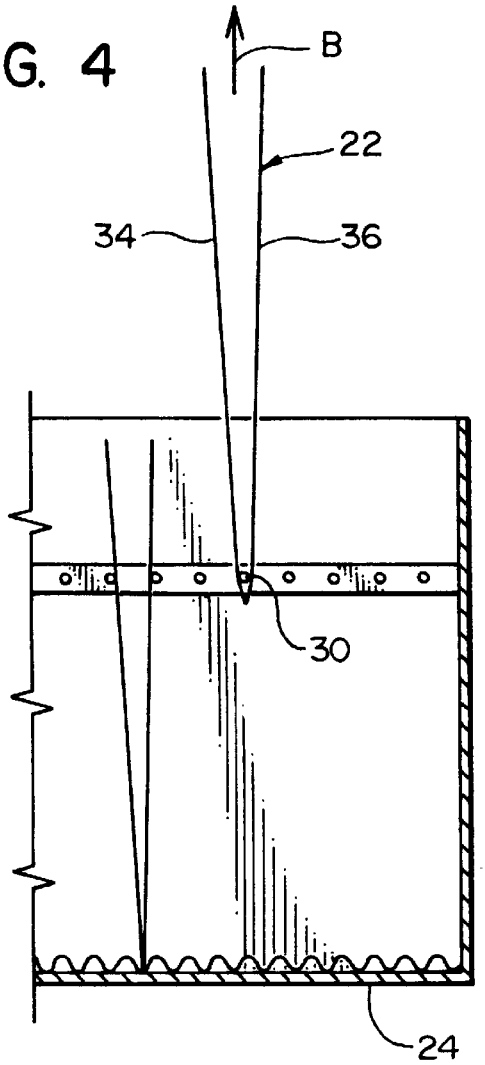
FIGS. 4 and 5 depict how the projections used by the system shown in FIG. 1 may distort to allow files to be removed therefrom.
Figure 5:
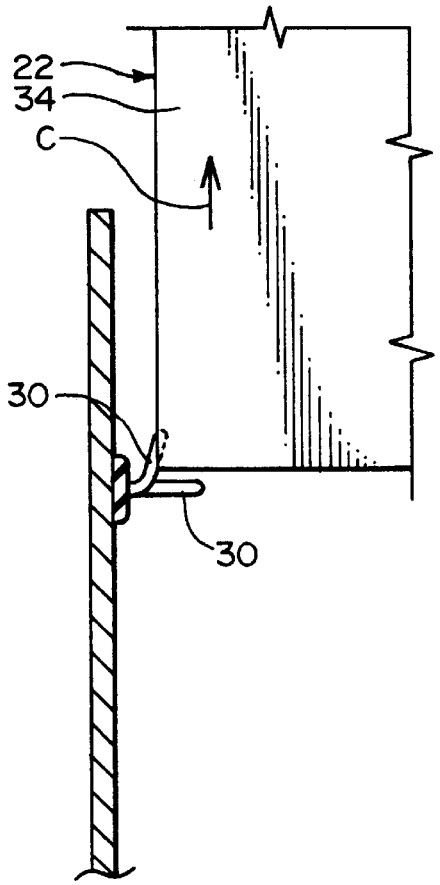

Referring now to FIGS. 2–5, the exemplary system 20 will be described in further detail. FIGS. 2 and 5 show that the projections 30 are preferably made somewhat flexible and are preferably made of pure gum rubber. This flexibility allows the file 22 to be manipulated within the box 24 as shown in FIG. 2 or removed from the box as shown in FIGS. 4 and 5 without interference from the projections 30.

For example, as shown in FIG. 2, if one needs to open the file 22 wider to view the contents 38 thereof, the flap 36 is simply pushed in the direction shown by arrow A. The projection 30 distorts to allow the flap 36 to move and thereby create a wider opening between the flaps 34 and 36.

In FIGS. 4 and 5, the situation is depicted in which the file 22 is being removed from the box 24 by being lifted in the direction shown by arrows B and c out of the box 24. Should one of the projections be between the flaps 34 and 36 of the file 22 as the file 22 is lifted, the projection 30 will simply bend as shown in FIG. 5 to allow the file 22 to be lifted from the box 24.

FIG. 2 shows that the support strips 26 further comprise a backing strip 40 from which the projections 30 extend. FIG. 2 also shows details of a side wall 42 of the box 24. The exemplary box 24 is a conventional corrugated paperboard box.

The backing strip 40 has an adhesive material formed on or applied to its outer surface 44. This adhesive material securely attaches the strip 40 onto an inner surface 46 of the wall 42.

The exemplary strip 26 shown in FIG. 1 is made out of a polymeric material such as plastic or synthetic rubber. However, this strip 26 may be made from any of a number of materials including metal, rubber, and cellulosic materials such as paperboard and the like.

The exact material selected is not critical to implementing the principles of the present invention as long as the material can be formed into projections 30 that have sufficient rigidity to bold an upper portion of the file and sufficient flexibility to be bent for the purpose discussed in relation to FIG. 2.

Referring now to FIG. 3, depicted therein is the corrugated sheet 28 and a bottom wall 48 of the box 24 The corrugated sheet 28 may be conventionally made out of paperboard such that it has an alternating series of grooves 50 and ridges 52 of sufficient size to receive the bottom 32 of the file 22 and prevent file creep within container 24. The ridges 52 are generally horizontally oriented when the box 24 is under normal use.

The corrugated sheet 28 may extend over an entire bottom surface 54 of the box 24 as indicated in FIG. 1, or may be configured in one or more strips extending the length of the box 24 in a manner that adequately supports the bottom end 32 of the file 22.

While the system 20 is depicted with a 30 corrugated sheet 28 for supporting a bottom portion of the file 22, narrow strips of this corrugated material rather than the sheet 28 shown may be preferable. Also, one or preferably two strips such as the strip 26 may be attached to the bottom surface 54 of the container 24 such that the projections 30 extend upwardly rather than horizontally.

The narrow strips of corrugated material or strips 26 having projections 30 may be preferable to the corrugated sheet 28 because, if the file 22 becomes twisted within the box, its bottom end may not be received within the valleys SO, allowing this bottom end to slide along the tops of the ridges 52.

With narrow strips of corrugated material or the projections 30, if the file 22 is twisted the bottom portion of the file Will still be supported. And if the strips 26 are used on the bottom of the container 24, the bottom edge of the file will clearly be supported if the file 22 is not skewed within the box. In this case, the lower end will be held between a given pair of projections 30 on each side at the bottom of the container 24. If, however, the file 22 becomes skewed, its bottom will still be held within the pair of projections in front of or in back of the projections it would be between if the file was not skewed.

In other words, it may be preferable to provide point support on the bottom surface of the container 24 with projections such as those identified at 30 on the side walls rather than line support such as that provided by tho valleys SO of the corrugated sheet 28.

Each of the embodiments disclosed herein would require bottom support in some way to hold the files upright, oven if that bottom support is not specifically shown in the Figures associated with that embodiment.

An adhesive may be used at an inner face 56 between a lower surface 58 of the corrugated sheet 28 and the bottom surface 54 of the box 24. It may also be possible that an integrated corrugated surface may be formed on the box 24 during manufacturing.

Figure 6:
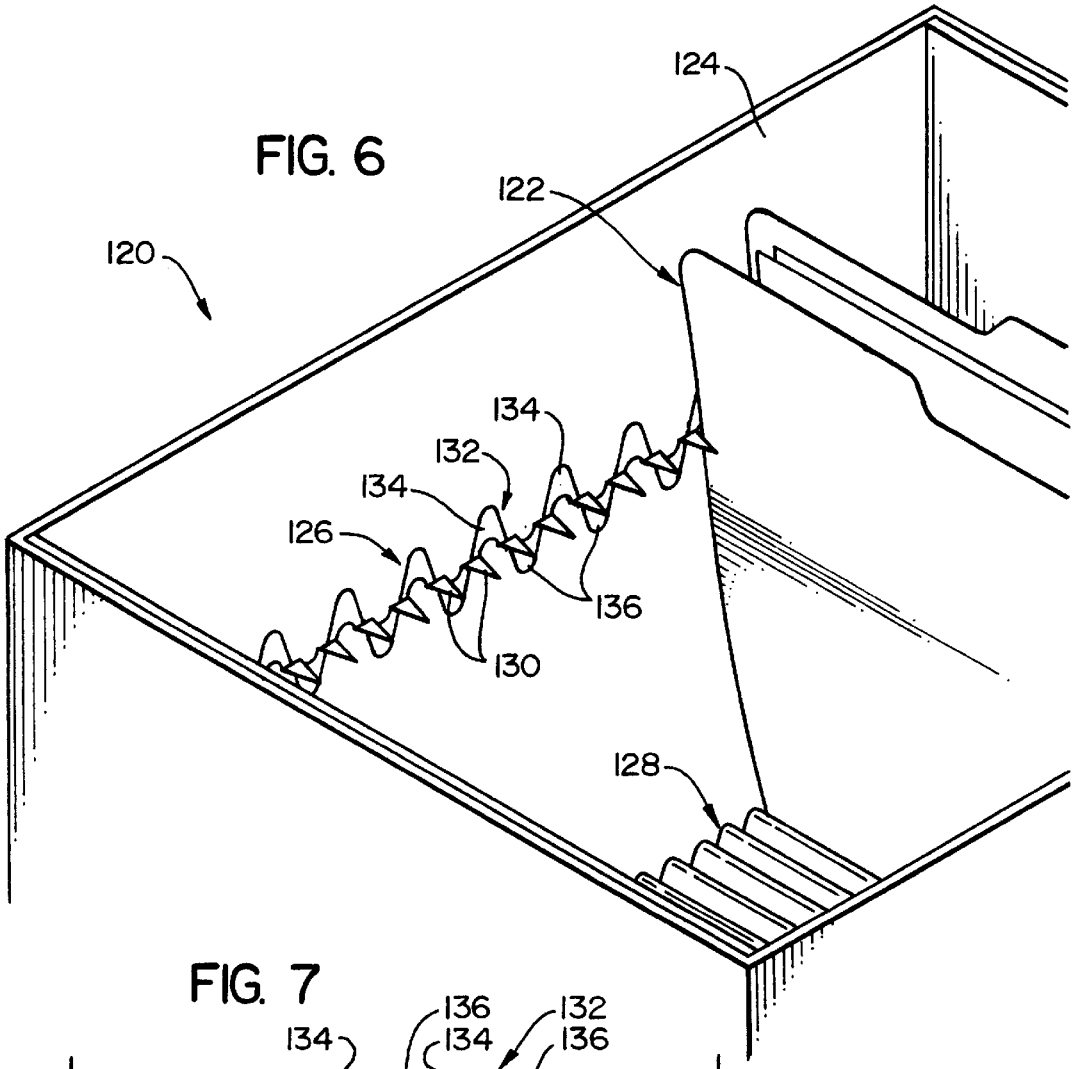
FIG. 6 is a perspective view showing another embodiment of the present invention.
Figure 7:
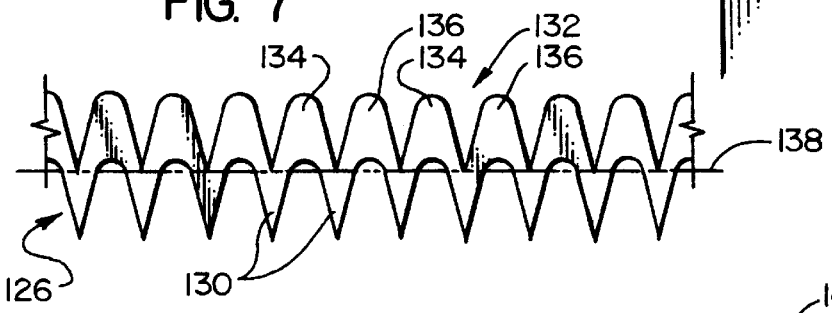
FIGS. 7 and 8 are top plan views showing how the support strip of the system shown in FIG. 6 may be cut out of a single sheet of material.
Figure 8:
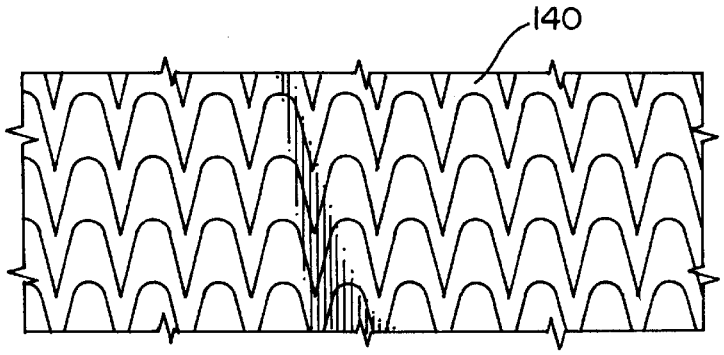

Referring now to FIGS. 6–8, depicted therein at 120 is a second support system constructed in accordance with the present invention. This support system 20 is also adapted to maintain a file 122 in an upright configuration within a box 124.

The system 120 comprises the box 124, a support strip 126, and a corrugated sheet 128. The primary difference between the support systems 20 and 120 is in the design of the support strip 126. Accordingly, only the support strip 126 will be described in detail with the understanding that the remaining components or the system 120 are constructed and used in the same basic manner of the similar components of the system 20 described above.

As with the support strip 26 described above, the support strip 126 comprises a series of inwardly projecting projections 130 adapted to engage the file 122 and maintain it in an upright position. The strip 126 further comprises a backing structure 132 comprising an alternating series of upwardly and downwardly extending attachment flanges 134 and 136, respectively. The strip 126 thus comprises in a repeating series an upwardly extending support flange 134, a projection 130, a downwardly extending support flange 136, and another projection 130.

The benefits of this arrangement is that the strip 126 may be die cut out of a flat sheet of material in a very efficient manner. Referring now to FIG. 7, the strip 126 is shown in an unfolded orientation before it is applied to the box 124. Before it is folded, all of the projections 130 and flanges 134 and 136 are arranged in & single plane with the flanges 134 and 136 extending in the same direction from a reference line 138. To obtain the configuration shown in FIG. 6, the flanges 134 and 136 are folded in opposite directions along a plane extending orthogonal to the page in FIG. 7 and passing through the reference line 138.

FIG. 8 shows how a plurality of the strips 126 may be cut out of a single sheet 140 while wasting only a minimum amount of the material from which the sheet 140 is made. The materials from which the sheet 140 is made are not highly critical, but the sheet 140 will likely comprise multiple layers, with each layer serving a different function when the strip 126 is used as shown in FIG. 6. The strip 126 thus must have sufficient adhesion to allow it to be attached to the box 124 and sufficient strength to allow the projections 130 to maintain the file 122 in the upright position.

Figure 9:
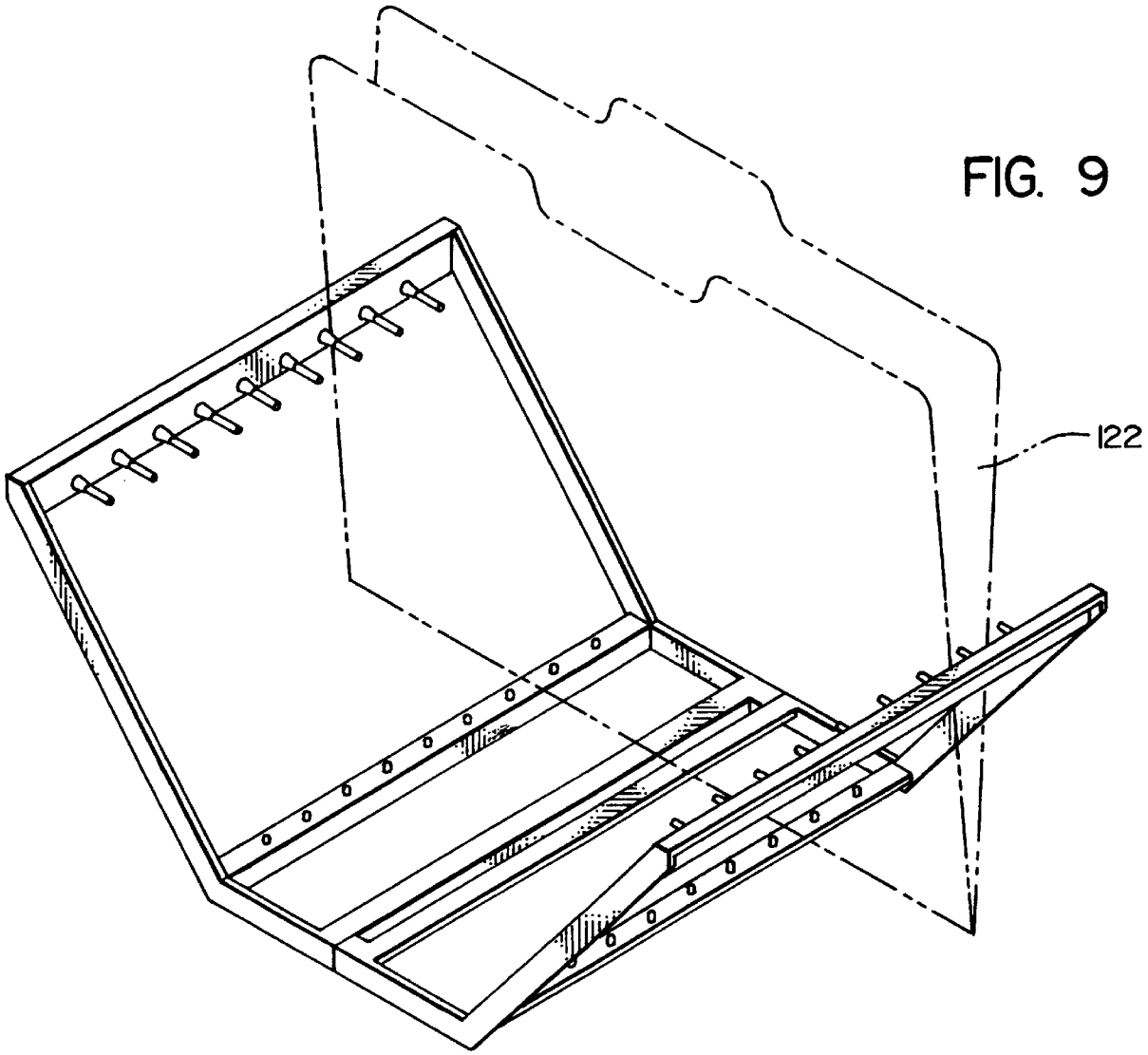
FIGS. 9 and 10 are perspective views showing a support system constructed in accordance with, and embodying, the principles of the present invention.
Figure 10:
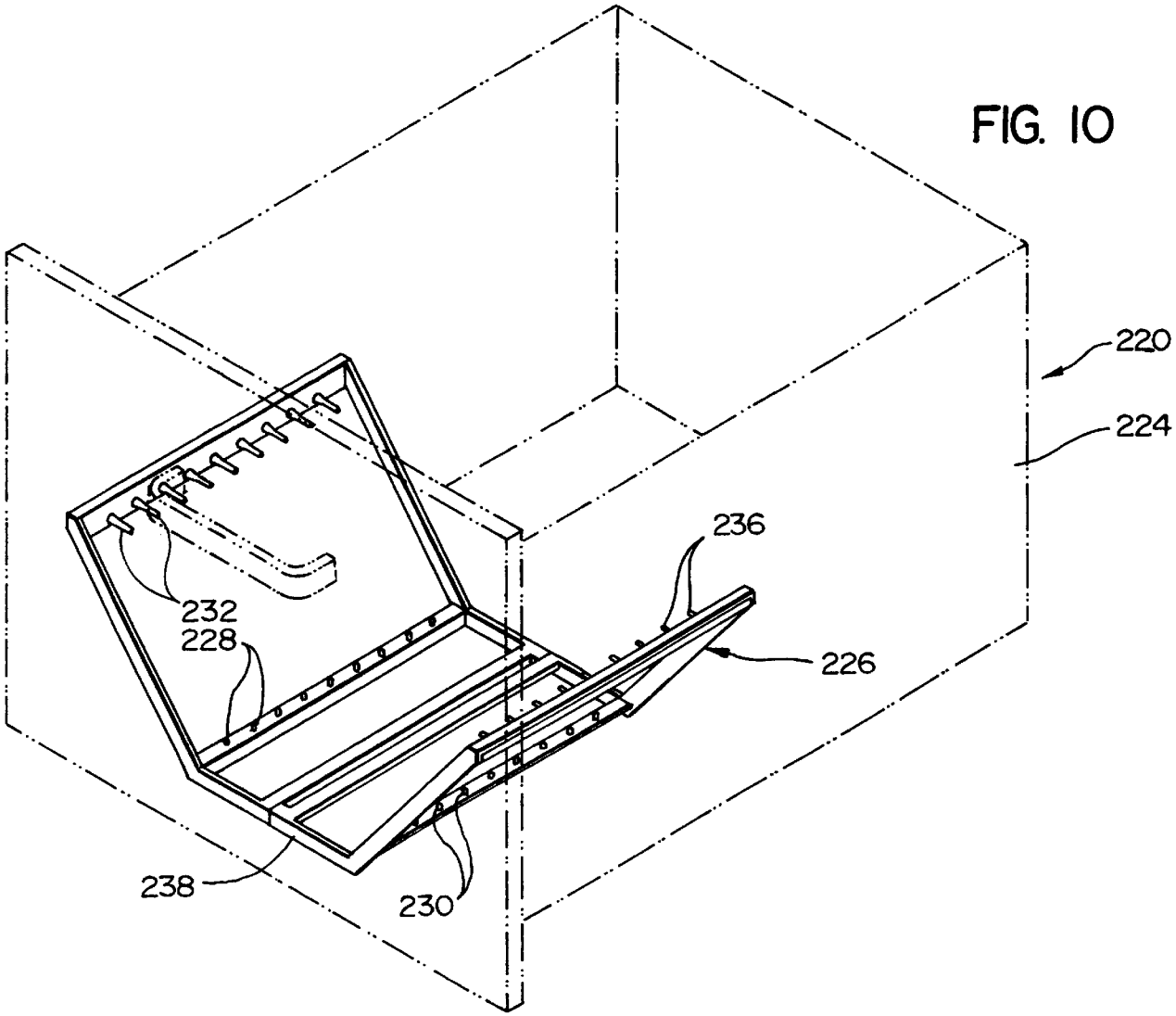

Referring now to FIGS. 9 and 10, yet another example of a support system constructed in accordance with, and embodying, the principles of the present invention is shown. The support system 220 is portable and removable from the file container and is adapted to maintain a file 222 in an upright position within a file container 224 such as a file drawer. It should be noted that many of the file support systems disclosed herein can be used either with a paperboard box or a file drawer. The depiction of one or the other container for any given embodiment is not intended to limit that embodiment to that type of container.

The system 220 basically comprises the file container 224 and a support structure 226. The support structure 226 comprises upwardly extending projections 228 and 230 arranged adjacent to a bottom of the container 224 and projections 232 and 236 projecting towards the interior of the box 224. These projections 228–236 are mounted on a structural frame 238.

The support system 220 operates in the same basic manner as the systems 20 and 120 described above. The projections 228 and 230 perform the same basic function as the corrugated sheets 28 and 128 described above, while the projection 232 and 236 serve the same function as the projections 30 and 130 described above. The primary difference between the system 220 and the systems 20 and 120 described above is that the structural integrity of the system that allows it to maintain the files in the upright position is provided by the structural assembly 238 and not the container 224. The exact configuration of the structural assembly 238 is not critical to implementing the present invention, as long as sufficient rigidity is provided to maintain files in an upright position as described above.

It should also be noted that the system 220 can be removed from the container 224, and allows a number of files to be removed from the container 224 and be maintained in order in an upright position outside of the container.

Figure 11:
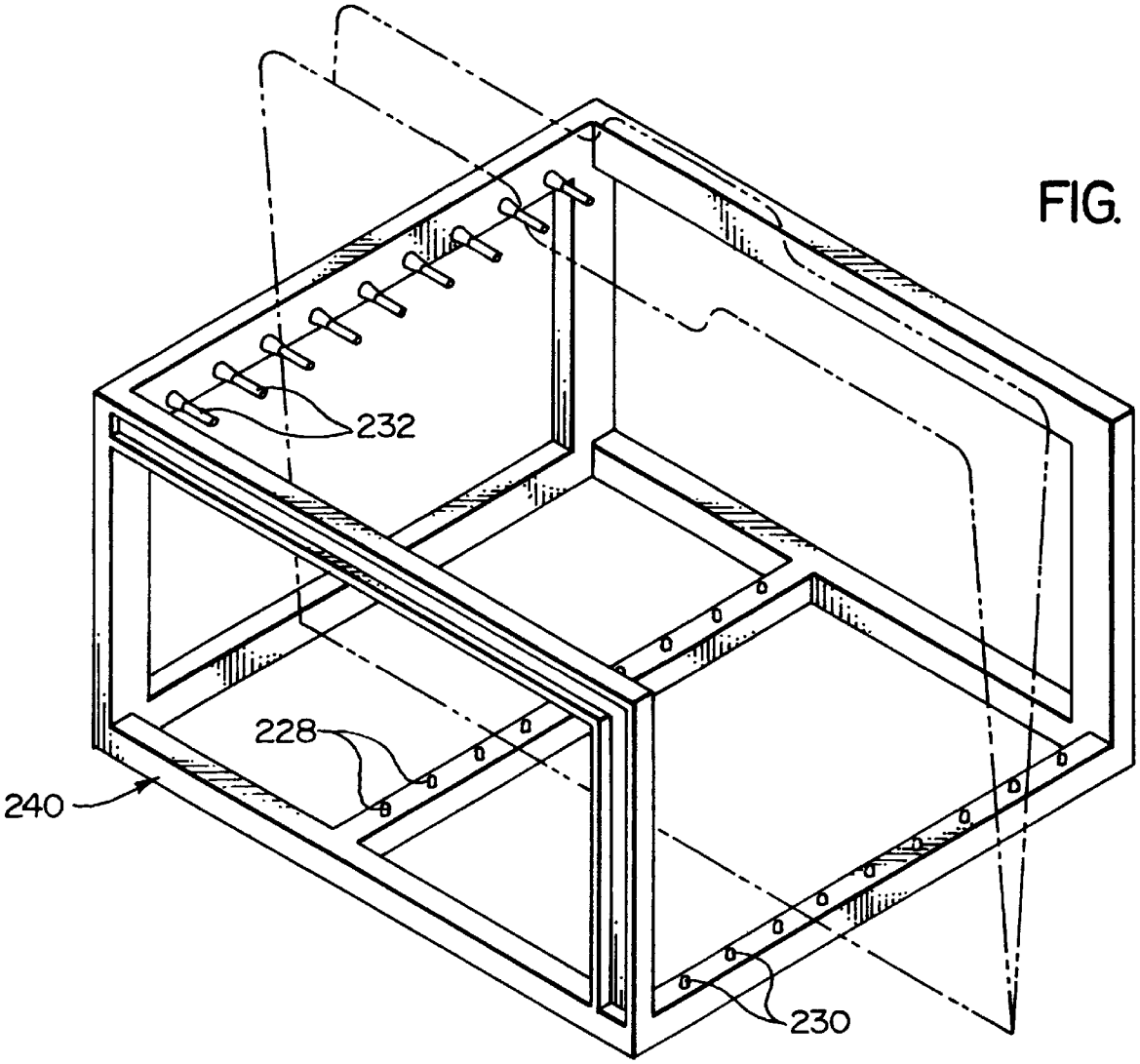
FIG. 11 is a perspective view of a modified version of the system shown in FIGS. 9 and 10.

A variation on the system 220 described above as shown in FIG. 11. FIG. 11 discloses an alternate structural assembly 240 having the projections 220, and 230 for supporting a bottom of a file and projections 232 for supporting one side of the file. structural assembly 240 has one open side and does not contain a set of support projections corresponding to the projections 236 shown in FIG. 10. A support system incorporating the structural assembly 240 would take up less room than one including the structural assembly 238, but would provide less support for the files as only one side thereof is braced.

Figure 12:
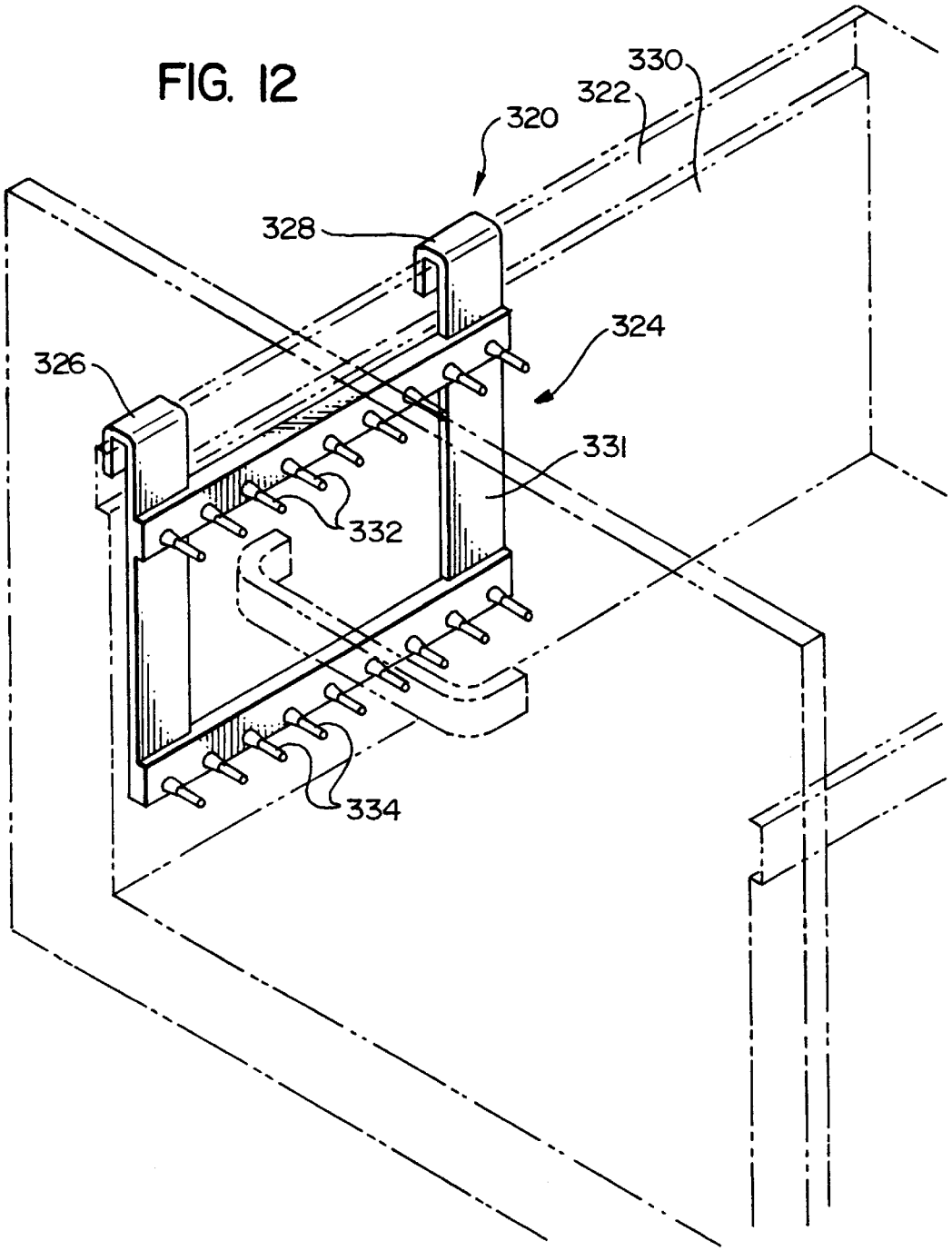
FIG. 12 depicts yet another exemplary support system constructed in accordance with the principles of the present invention.

Referring now to FIG. 12, yet another exemplary embodiment of a file support system incorporating the principles of the present invention is shown at 320. This system 320 incorporates a file container such as a file drawer 322 and first and second bracing assemblies 324. The bracing assemblies 324 are identical and only one is shown in FIG. 12.

The bracing assembly 324 has two upwardly extending hooks 326 and 328 adapted to engage a side wall 330 of the container 322. With the hooks 326 and 328 engaging the side wall 330, a frame 331 is suspended along this wall 330 within the container 322.

A first set of projections 332 extends from an upper portion of the frame 331, and a second set of projections 334 extend from a lower portion of the frame 331.

During use, the projections 332 and 334 engage upper and lower portions of a side of a file to maintain this file in an upright position. As briefly discussed above, another support assembly 324 is arranged on the opposing side of the container 322 such that its upper and lower projections oppose the projections 3o32 and 334 shown in FIG. 12.

With the system shown at 320, it is not necessary to provide upwardly extending ridges or projections on the bottom of the container 322 such as those used in the other embodiments because the lower projections 334 support the lower portion of the file.

Figure 13:
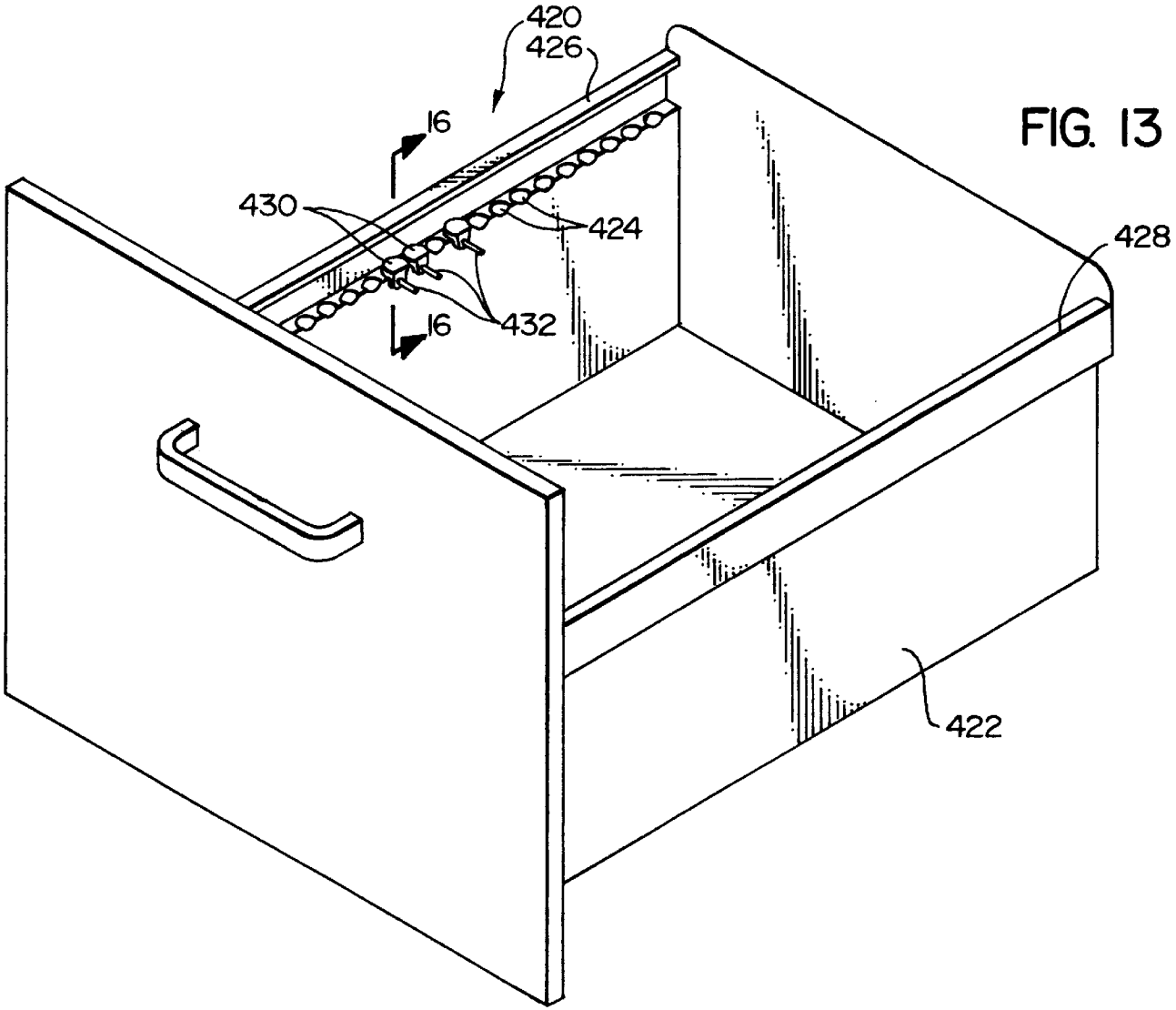
FIG. 13 depicts yet another embodiment of the principles of the present invention as applied to a file drawer.

Referring now to FIG. 13, yet another exemplary file support system 420 is shown therein. The system 420 shown in FIG. 13 is specifically adapted to hold files upright within a file drawer 422. Many commercially available file drawers 422 have a series of holes 424 formed on an inside upper portion of the side walls 426 and 428. In this system 420, a plurality of bracing members 430 are received within these holes 424 such that projections 432 extend inwardly to support files in an upright position.

Figure 14:
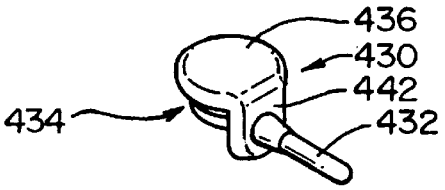
FIG. 14 is a perspective view showing a support member used by the system shown in FIG. 13.
Figure 16:
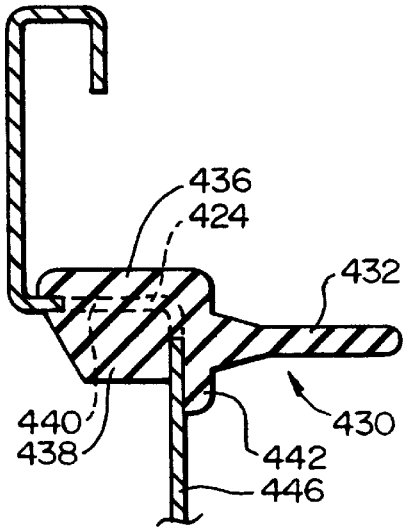
FIG. 16 is a side cutaway view showing the installation of the support member shown in FIG. 14 in the system shown in FIG. 13.
Figure 15:
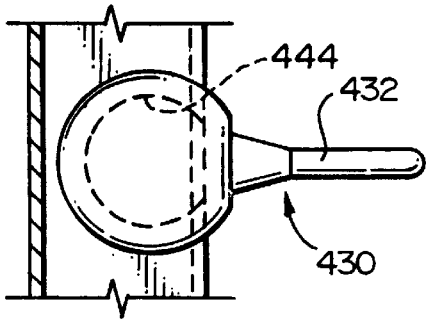
FIG. 15 is a top plan view showing a detail of the system shown in FIG. 13.

Referring now to FIGS. 14–16, the details of construction and use of the support members 430 will be described. FIG. 14 shows that the support members 430 comprise a base portion 434 and the projection 432. The base portion 434 comprises a large diameter upper portion 436 and a relatively Small diameter lower portion 438. A groove 440 extends around a substantial portion of the base portion 436 between the upper portion 436 and the lower portion 438. The projection 432 extends from a bracing portion 442.

In use, the lower portion 438 is passed through one of the openings 424 until a peripheral edge 444 defining the opening is received within the groove 440. The bracing portion 442 engages an inner wall 446 of the container side 426 to maintain the projection 432 in a substantially horizontal orientation. The system 420 is used in the same basic manner as the systems described above, and this use need not be discussed in further detail.

As perhaps best shown in FIG. 16, the member 430 is formed of a unitary piece of resilient material such as rubber or synthetic rubber. Such resilient materials allow the member 430 to be pressed into the holes 424. While the arrangement described above prevents inadvertent removal of the members 430, they can be removed with an appropriately applied peeling action.

Figure 17:
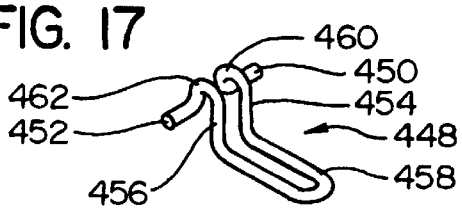
FIG. 17 shows an alternative support member to be used by the system shown in FIG. 13.
Figure 19:
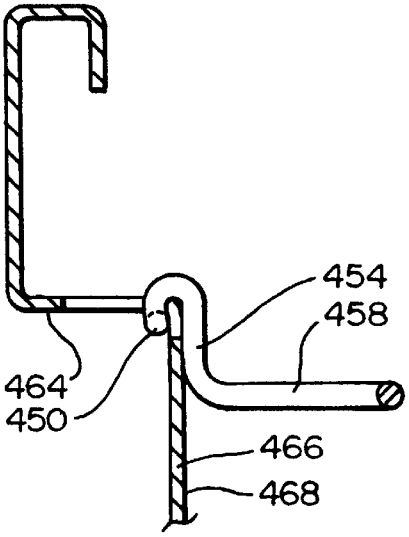
FIG. 19 is a side cutaway elevational view showing the installation of the support member shown in FIGS. 17 and 18.
Figure 18:
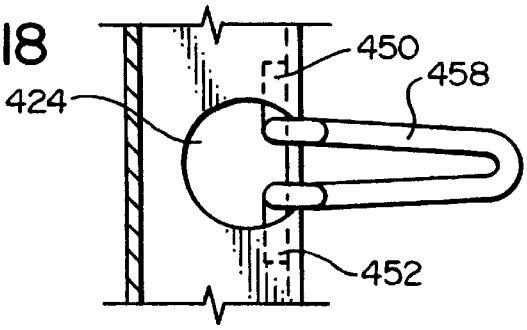
FIG. 18 is a top plan view showing the installation of the support member shown in FIG. 17.

Referring now to FIGS. 17–19, shown at 448 therein is another exemplary support member 448 that is used in substantially the same manner as the support member 430 described above. The member 448 is formed from a single piece of semi-rigid wire having first and second side projections 450 and 452, Two vertical bracing portions 454 and 456, a horizontally extending support loop 458, and first and second connecting loops 460 and 462 connecting the side portions 450 and 452 with the bracing portions 454 and 456.

As shown in FIGS. 18 and 19, the side members 450 and 452 extend into the holes 424 and engage a bottom surface 464 of the container inner wall 466. The bracing members 454 and 456 engage an outer surface 468 of the wall 466 to maintain the support loop 458 in a substantially horizontal orientation.

As with the support projections described above, the support loop 458 engages a side edge of a file to maintain the file in an upright position within the container 422.

To be used as described above, the member 458 is preferably made out or & single strand of semi-rigid spring steel.

Figure 20:
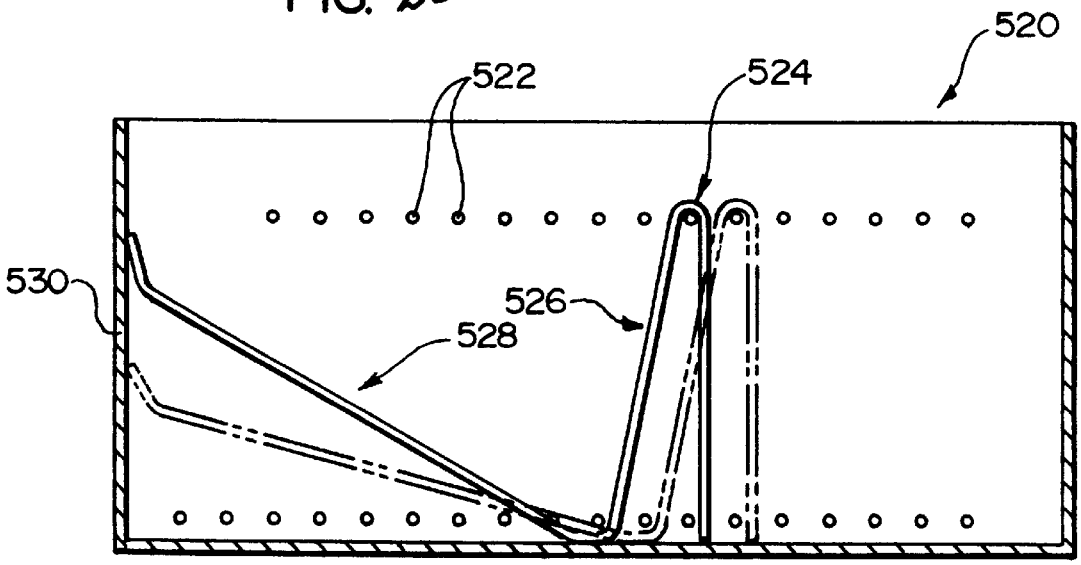
FIG. 20 shows an adaptation of the principles of the present invention to a parts storage bin.

Referring now to FIG. 20, that drawing shows a container system 520 adapted for use as a parts bin or the like. In particular, support projections 522 such as those described above support a separator member 524. The separator member 524 comprises a rear wall portion 526 and a bottom wall portion 528. The rear wall portion 526 defines a rear wall of the compartment defined by the storage system 520. This rear wall is movable forward and backward to accommodate the number or parts to be held within the container system 520. When fewer parts are stored thereby, the back wall 526 is moved towards the front to create a smaller storage space. The bottom wall 528 engages a front wall 530 such that the bottom wall 528 slants upwardly 89 the back wall 526 moves forward. This shifts parts towards the back of the compartment so that they are more accessible.

Figure 21:
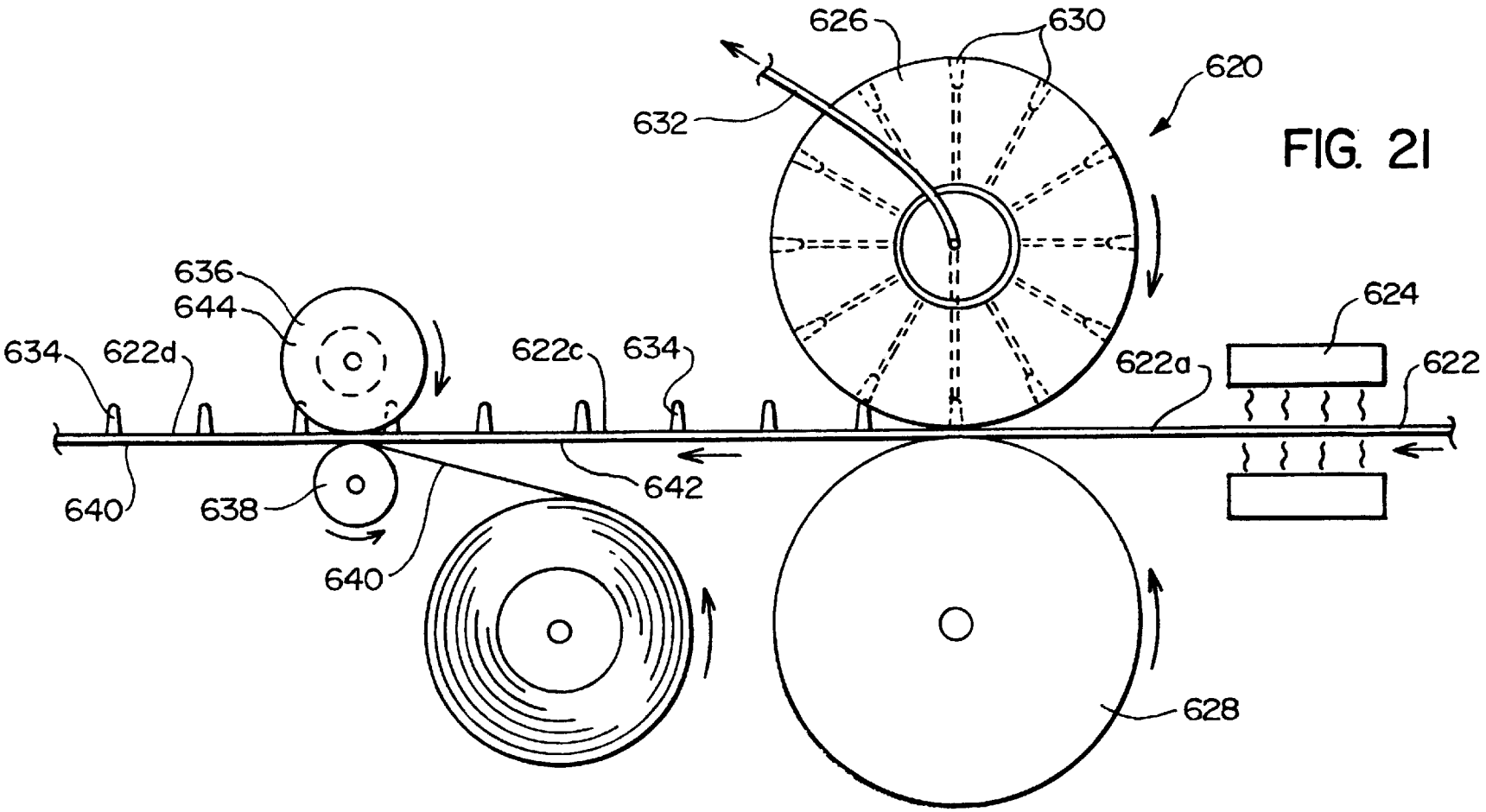
FIG. 21 depicts a method of manufacturing a support strip such as that used in the system shown in FIG. 1.
Figure 22:
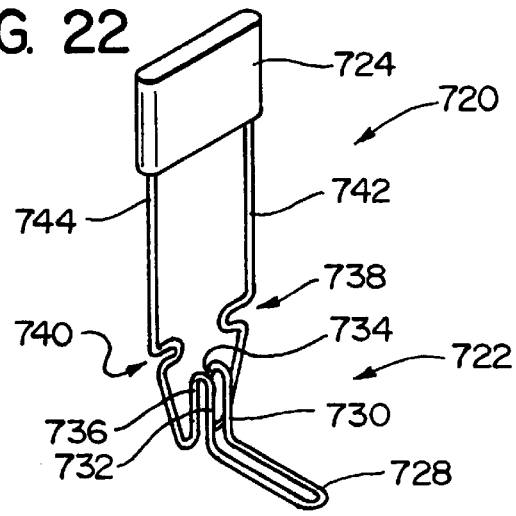
FIG. 22 depicts another support member such as that used by the system shown in FIG. 13.
Figure 23:
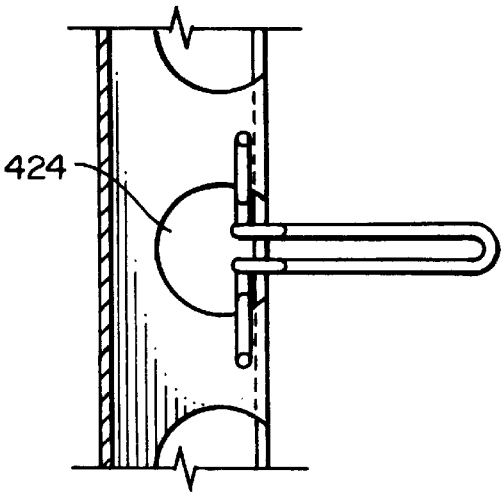
FIG. 23 is a top plan partial cutaway view of the system shown in FIG. 13 using the support member shown in FIG. 22.
Figure 24:
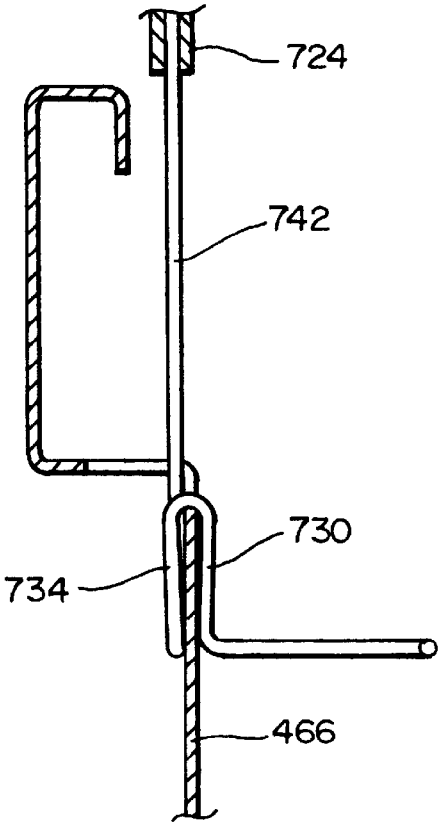
FIG. 24 is a side elevational partial cutaway view showing the installation of the support member shown in FIG. 22.
Figure 25:
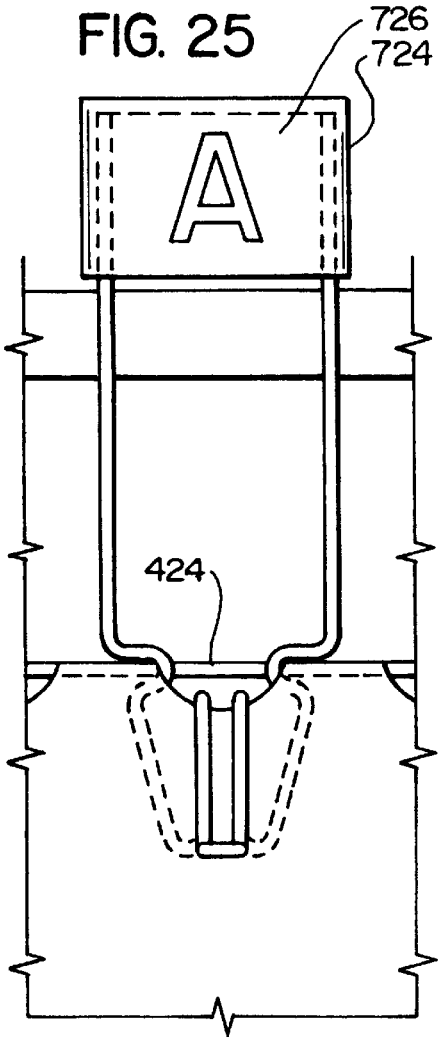
FIG. 25 is a partial side elevational view of the installed support member as shown in FIG. 22.

FIG. 21 depicts a process for manufacturing the support strip 26 described above. Initially, blank material 622 is fed through a heater 624 which makes this material 622 somewhat pliable.

The pliable material 622*a* is then red between upper and lower rollers 626 and 628. The lower roller 628 is simply a support roller. The upper roller 626 has a series of cavities 630 extending around the periphery thereof. These cavities 630 are connected by a conduit 632 to a vacuum source such that when any one of these cavities 630 comes into registration with the heated material 622*a,* a vacuum is momentarily applied thereto which causes a portion of the material 622 to be drawn into the cavity 630 and registration therewith. After the vacuum is applied to draw a portion of the material 622 into the cavity 630, the cavity 630 is pressurized to collapse the material 622 and eject this material from the cavity 630.

Thus, downstream of these rollers 626 and 628 the material 622*c* has formed thereon projections 634 that correspond to the projections 30 described above.

At that point, the material 622*c* passes between upper and lower rollers 636 and 638. Also passing between these rollers 636 and 638 is a web of adhesive material 640 that is bonded to a lower surface 642 of the material 622*c*. Downstream of the roller 636 and 638, the material 622*d* thus comprises projections 634 on one surface and an adhesive material 640 on the other surface. To accommodate the projections 634, a groove 644 is formed in the upper roller 636.

While a continuous vacuum-forming system as shown in FIG. 18 is the preferred method at this point, other manufacturing techniques may be made to manufacture strips such as the strips 26 described above. In particular, this material may be vacuum molded in a batch process rather than a continuous process, injection molded, stamped or die cut, or any other appropriate technique. The advantage of the system shown in FIG. 21 is that it is continuous and employs techniques that are fairly well known in other arts.

Referring now to FIGS. 22–25, depicted therein is yet another exemplary support member 720 similar to the support members 448 described above. The support member 720 comprises a support portion 72~ and an index portion 724. The support portion 722 is adapted to engage the holes 424 as generally described above. The indexing portion 724 is mounted on an upper end of the support portion 722 such that an indexing surface 726 is clearly visible above the tops of the file supported by the member 720. Formed on the indexing surface 726 are letters or other indicators that identify the files supported thereby.

The support portion 722 comprises a support loop 728, outer bracing portions 730 and 732, inner bracing portions 734 and 736, notch portions 738 and 740, and riser portions 742 and 744 The notch portions 738 and 740 engage the holes 424 such that the outer bracing portions 730 and 732 and the inner bracing portions 734 and 736 straddle the side wall 466. The outer bracing portion 730 supports the support loop 728 in a substantially horizontal orientation. The riser members 742 and 744 extend upwardly such that the indexing member 724 is at the appropriate level for easy viewing.

Figure 26:
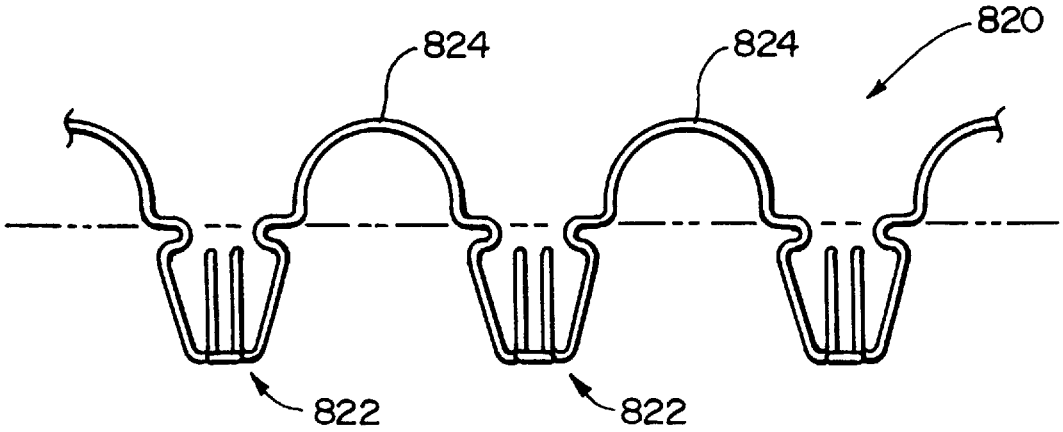
FIG. 26 is a front elevational view showing a plurality of support members such as those shown in FIGS. 17 and 22 formed from a single piece of continuous wire.

Referring now to FIG. 26, a support strip 820 is shown. This strip 820 engages the holes 424 in a file drawer in a manner similar to the support member 720 described above. But rather than having a single discrete support member, this strip 820 comprises a plurality of support members 822 that are connected at a spacing distance substantially equal to that of the spacing between the holes 424. Each individual spacing member 822 is connected to its adjacent support members 822 by a flexible wire loop portion 824. Any variability in the distance between boles 424 can be accommodated by the resiliency of the wire loop portions 824. Accordingly, a plurality of support meters may be formed or & single continuous piece of semi-rigid wire that may simplify installation of a series of projections.

Figure 27:
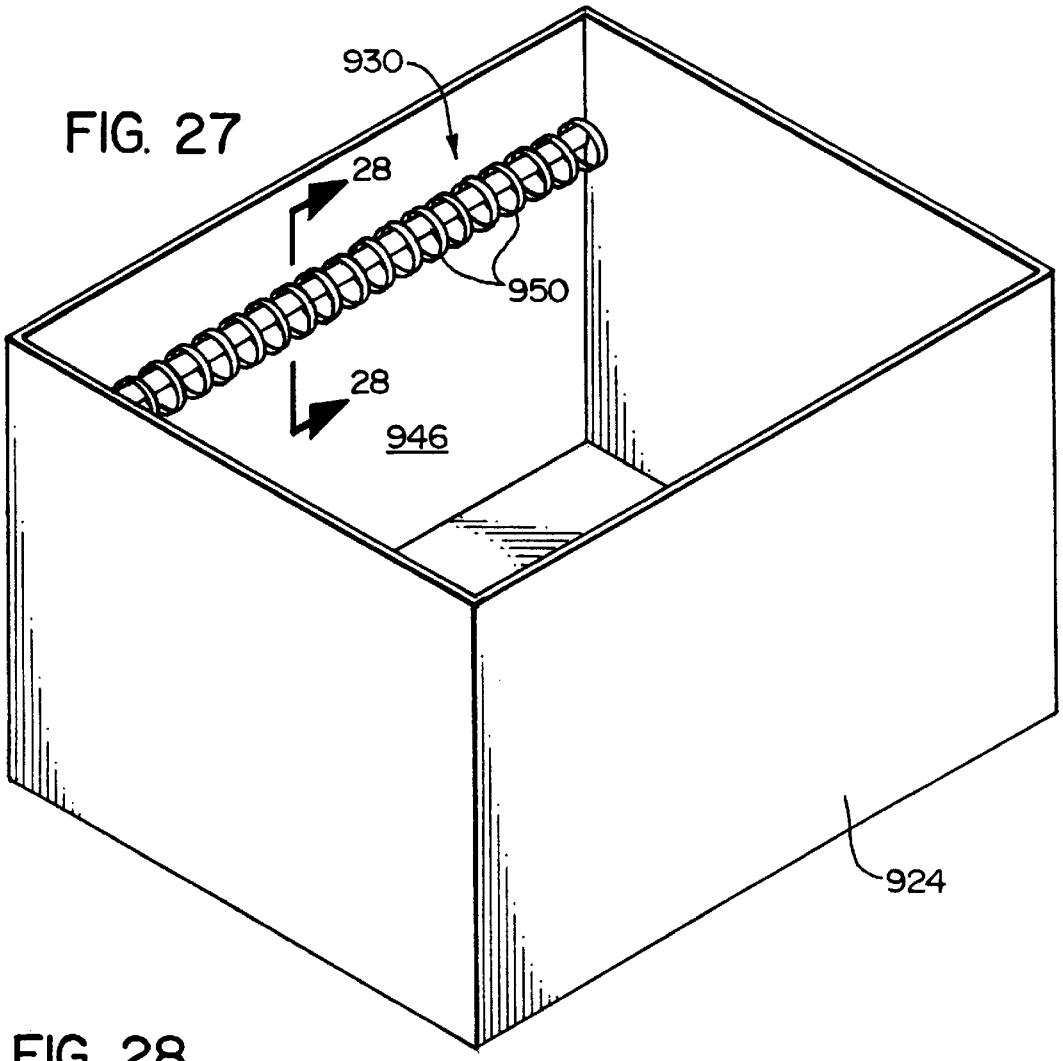
FIG. 27 is a perspective view of a still further embodiment of the present invention.
Figure 28:
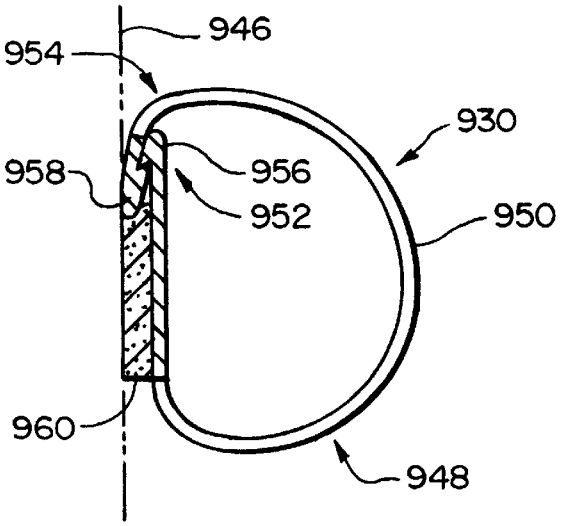
FIG. 28 is a sectional view taken on lines 28—28 of FIG. 27.
Figure 29:
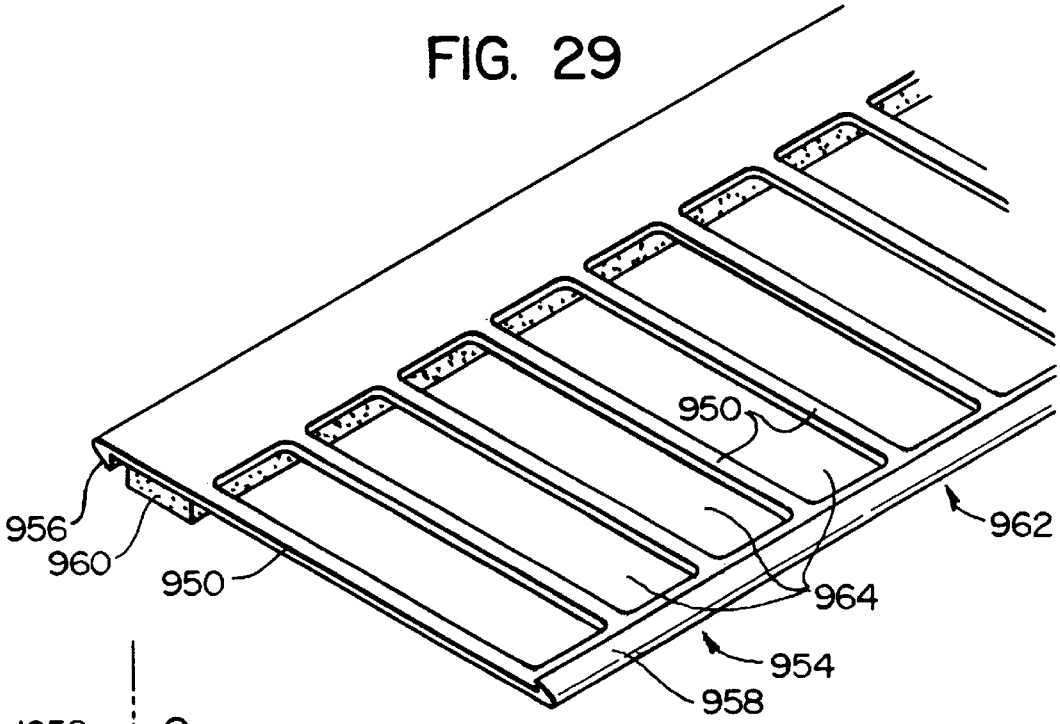
FIG. 29 is a perspective view of an unassembled support member of FIG. 28.

Turning now to FIGS. 27–29, an embodiment similar in function to the embodiment of FIG. 1 is disclosed. This embodiment comprises a plurality of linear, deformable members 930 arranged adjacent one another so as to retain a plurality of files (not shown) therebetween, within container 924. As shown, a single strip 926 is positioned within container 924, however it is to be understood that a lower strip could advantageously be positioned beneath the strip 930, or alternatively, a corrugated bottom member as illustrated in FIG. 1 could be utilized.

The member 930 comprises an elongate loop portion 950, a first secured end 952 and a second movable end 954. The first end 952 is provided with interlocking means, such as a hook portion 956, which is adapted to interlock with a similar hook portion 958 provided as the terminus of the second end 954. An adhesive member 960 secures the first secured end 952 to an inner surface 946 of the container 924.

The apparatus 930 of FIGS. 27 and 28 may be constructed from a single sheet of deformable material 962 as illustrated in FIG. 29. According to this embodiment, a sheet 962 of, for example, a thermoplastic or rubber material, may be formed or extruded, and an appropriate length cut to fit a particular container size. When formed, the material 962 is formed with apertures 964 between adjacent elongate loop portions 950, so that when the entire second movable end 954 of strip 962 is moved upwardly (counter-clockwise in the view of FIG. 29) so that the hook portion 958 engages the hook portion 956, there will be spaces between adjacent loops 950.

Figure 30:
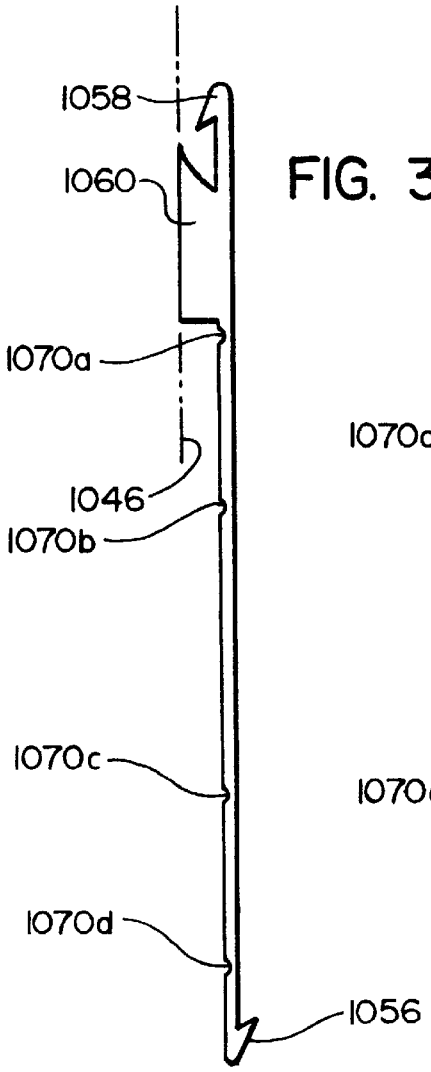
FIG. 30 is a side elevational view of another embodiment of the support member of FIG. 27 in the unassembled condition.
Figure 31:
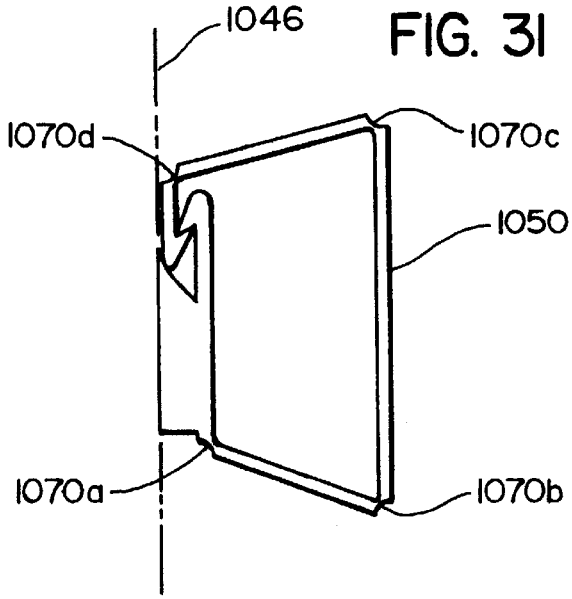
FIG. 31 is a side elevational view of the assembled support member of FIG. 30.

Finally, the embodiment of FIGS. 30 and 31 is similar to that of FIGS. 27–29, except that the elongate loop portion 1050 is provided with crease lines 1070*a–d* to effect a mode angular loop than the curved loop of FIG. 27. In this embodiment, the movable end is provided with a hook portion 1056 which is moved into engagement with the stationary hook portion 1058. The device is secured to the inner surface 1046 of a container with an adhesive portion 1060. The embodiment of FIG. 30 may be manufactured in the same manner as illustrated in FIG. 29.

It is to be appreciated that while the embodiments illustrated herein have been shown in the context of a support system added after construction of the file container, the inventive filing system may be manufactured as an integral feature of the container. A number of the embodiments illustrated herein, for example as shown in FIGS. 12–19 are of necessity installed after the container is manufactured. However, the remaining embodiments may be manufactured coincident with the manufacture of the container and sold as a unitary structure.

The present invention may be embodied in other specific forms without departing from the essential characteristics thereof. The present embodiments are therefore to be considered in all respects as illustrative and not restrictive.

I claim:

1. A system adapted to retain file members having little or no inherent structural integrity, in a substantially vertical alignment within a file container, said system comprising:

a. a plurality of spaced-apart deformable, resilient upper retention members adapted to engage an upper portion of the side of each of said file members, said upper retention members aligned generally horizontally on an upper portion of at least one inner wall of the container;

b. a lower retention member aligned generally horizontally on a lower portion of the container and adapted to engage a lower portion of each file member; and c. said upper and lower retention members providing resistance to unintended front-to-back movement of files within the container while permitting a user to move files within the container or to remove files therefrom.

2. The system of claim 1, wherein the upper retention members comprise a plurality of adjacent projections having an operative space therebetween, and projecting inwardly into the center of the container from a side wall of the container.

3. The system of claim 2, wherein the upper retention members comprise a pair of opposed members mounted to opposing side walls of the container such that they engage opposing ends of a file retained therein.

4. The system of claim 2, wherein the upper retention members comprise a plurality of adjacent loop members having an operative space therebetween, and projecting inwardly into the center of the container from a side wall of the container.

5. The system of claim 1, wherein the upper and lower retention members are affixed to an existing container after manufacture of the container.

6. The system of claim 5, wherein the container comprises a portable corrugated cardboard filing box.

7. The system of claim 5, wherein the container comprises a slidable file drawer within a cabinet.

8. The system of claim 1, wherein the upper and lower retention members are manufactured coincident with the manufacture of the container.

9. The system of claim 1, wherein the lower retention member comprises a corrugated planar member emplaced on a lower surface of the container and adapted to interfit with a lower surface of said file members.

10. The system of claim 1, wherein said upper retention members comprise a support strip upon which is provided a plurality of projections.

11. The system of claim 10, wherein said upper retention members comprise a support strip and a plurality of projections die cut from a planar sheet of deformable, resilient material.

12. The system of claim 1, wherein the system comprises a removable frame member having at least one upper arm with upper retention members thereon, and lower arms with lower retention members thereon.

13. The system of claim 12, wherein the removable frame member comprises a planar base portion to which the upper and lower arms are affixed and which is adapted to sit in the bottom of said container.

14. The system of claim 12, wherein the removable frame member comprises a pair of assemblies, each assembly having a pair of hooks adapted to engage a side wall of the container such that each assembly is hung from one side of the container.

15. The system of claim 1, wherein the upper retention members comprise a plurality of individual retention members each adapted to engage individual apertures provided in an upper portion of a side wall of the container.

16. The system of claim 15, wherein the upper retention members each comprise a support portion interfitting with apertures in the container, and an indexing portion having an index surface visible above said files and adapted to carry thereon index indicators to identify adjacent files.

17. The system of claim 1, wherein the upper retention members comprise a loop of deformable material.

18. The system of claim 17, wherein the loop comprises a first secured end affixed to the container and having a first interlocking portion, and a second movable end having a second interlocking portion and an elongate portion therebetween, such that when the second movable end is brought adjacent the first secured end, the first and second interlocking portions are interfitted one to the other.

19. The system of claim 17, wherein the loop comprises a first secured end affixed to the container and having a first interlocking portion, and a second movable end having a second interlocking portion and an elongate portion therebetween, said elongate portion having a plurality of crease lines therein to enable the first secured end to be brought into engagement with the second movable end.

20. A filing system comprising:

a. a file container having a pair of side walls, end walls and a bottom;

b. a plurality of spaced-apart deformable and resilient upper retention members affixed to an upper portion of each side wall, said upper retention members comprising a plurality of deformable file-engaging members adapted to engage an upper portion of each file; and c. a plurality of spaced-apart deformable and resilient lower retention members affixed to a lower portion of each side wall, said lower retention members comprising a plurality of deformable file-engaging members adapted to engage a lower portion of each file;

wherein the upper and lower retention members restrain said files from substantial movement within said container, but are deformable to permit file removal when desired.

* * * * *

UNITED STATES PATENT AND TRADEMARK OFFICE

CERTIFICATE OF CORRECTION

PATENT NO. : 5,819,922
DATED : October 13, 1998
INVENTOR(S) : Tim Martin, Jr.

It is certified that error appears in the above-identified patent and that said Letters Patent is hereby corrected as shown below:

Title page,
Item [60], should read -- Provisional application No. 60/010,105 January 16, 1996. --

Signed and Sealed this

Twenty-seventh Day of August, 2002

*Attest:*

*Attesting Officer*

JAMES E. ROGAN
*Director of the United States Patent and Trademark Office*